US008190062B2

(12) United States Patent
Maruyama et al.

(10) Patent No.: US 8,190,062 B2
(45) Date of Patent: May 29, 2012

(54) IMAGE FORMING APPARATUS WITH AN IMAGE CARRIER INCLUDING A LIGHT EMITTING ELEMENT LAYER

(75) Inventors: Hitoshi Maruyama, Tokyo (JP); Kenichiroh Saisho, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 430 days.

(21) Appl. No.: 12/417,166

(22) Filed: Apr. 2, 2009

(65) Prior Publication Data

US 2009/0257780 A1 Oct. 15, 2009

(30) Foreign Application Priority Data

Apr. 11, 2008 (JP) ..... 2008-103122

(51) Int. Cl.

| | |
|---|---|
| ***G03G 15/01*** | (2006.01) |
| ***G03G 15/04*** | (2006.01) |
| ***G03G 15/08*** | (2006.01) |
| ***G03G 15/00*** | (2006.01) |
| ***G03G 13/01*** | (2006.01) |

(52) U.S. Cl. ..... 399/223; 399/177; 399/178; 399/290; 399/159; 430/42.1; 430/45.4

(58) Field of Classification Search ..... 399/178; 347/115

See application file for complete search history.

(56) References Cited

U.S. PATENT DOCUMENTS

| | | | | |
|---|---|---|---|---|
| 5,541,029 | A * | 7/1996 | Iwata et al. | 430/45.1 |
| 5,716,744 | A * | 2/1998 | Yergenson | 430/45.31 |
| 5,837,408 | A * | 11/1998 | Parker et al. | 430/45.31 |
| 5,999,201 | A * | 12/1999 | Dalal et al. | 347/115 |
| 6,163,672 | A * | 12/2000 | Parker et al. | 399/223 |
| 6,188,861 | B1 * | 2/2001 | Parker et al. | 399/299 |
| 6,203,953 | B1 * | 3/2001 | Dalal | 430/47.2 |
| 6,266,073 | B1 * | 7/2001 | Yergenson | 347/115 |
| 6,303,255 | B1 * | 10/2001 | Sakaguchi et al. | 430/97 |
| 6,352,806 | B1 * | 3/2002 | Dalal | 430/45.4 |
| 6,701,116 | B1 * | 3/2004 | Aoki | 399/298 |
| 2006/0120765 | A1 * | 6/2006 | Sakai et al. | 399/265 |
| 2007/0015071 | A1 * | 1/2007 | Tsukamoto et al. | 430/45 |
| 2007/0086811 | A1 * | 4/2007 | Tsukamoto et al. | 399/265 |
| 2008/0124138 | A1 * | 5/2008 | Kosugi et al. | 399/285 |
| 2008/0131166 | A1 * | 6/2008 | Yokoyama et al. | 399/159 |
| 2008/0219702 | A1 | 9/2008 | Tsukamoto et al. | |
| 2008/0261768 | A1 | 10/2008 | Miyawaki et al. | |
| 2009/0074431 | A1 | 3/2009 | Aoki et al. | |
| 2009/0324303 | A1 * | 12/2009 | Crean et al. | 399/298 |

FOREIGN PATENT DOCUMENTS

| | | |
|---|---|---|
| JP | 8-87179 | 4/1996 |
| JP | 8-286456 | 11/1996 |
| JP | 10-3191 | 1/1998 |
| JP | 3014168 | 12/1999 |

* cited by examiner

*Primary Examiner* — David Gray
*Assistant Examiner* — David Bolduc
(74) *Attorney, Agent, or Firm* — Oblon, Spivak, McClelland, Maier & Neustadt, L.L.P.

(57) ABSTRACT

In an image forming apparatus that includes an image carrier, a charging unit, a latent-image forming unit that forms a latent image for each color by exposing the surface of the image carrier charged by the charging unit, and a plurality of developing units that sequentially develops latent images formed on the image carrier with toners of different colors including at least cyan, yellow, and magenta, to form a color toner image on a single unit of the image carrier, the developing units further develops the latent images with toners of blue, green, and red, such that the toner images of different colors are not superimposed on a same position.

9 Claims, 9 Drawing Sheets

IMAGE FORMING APPARATUS WITH AN IMAGE CARRIER INCLUDING A LIGHT EMITTING ELEMENT LAYER

CROSS-REFERENCE TO RELATED APPLICATIONS

The present application claims priority to and incorporates by reference the entire contents of Japanese priority document 2008-103122 filed in Japan on Apr. 11, 2008.

BACKGROUND OF THE INVENTION

1. Field of the Invention

The present invention relates to an image forming apparatus that forms a color image by superimposing a plurality of toner images of different colors.

2. Description of the Related Art

In general, a tandem-type color-image forming apparatus that includes a plurality of photosensitive elements for forming a color image has disadvantages such as a large apparatus size due to a large-sized image forming engine, a complex configuration, and a high cost. To overcome the disadvantages, a rotary-type color-image forming apparatus that includes a single photosensitive element is known, which is disclosed, for example, in Japanese Patent Application Laid-open No. H08-087179 and Japanese Patent Application Laid-open No. H10-003191. In the rotary-type color-image forming apparatus, toner images of a plurality of colors are sequentially formed one after another on the photosensitive element, and then collectively transferred onto a recording medium such as a recording paper.

The color-image forming apparatus reproduces a color image according to subtractive color mixture of cyan, yellow, magenta, and black by appropriately superimposing toner images of cyan, yellow, magenta, and black.

A method of forming a color image in an image forming apparatus disclosed in Japanese Patent Publication No. 3014168 by superimposing a plurality of toner images of different colors on a photosensitive element is as follows. A charging unit uniformly charges the surface of the photosensitive element and an exposure unit exposes an image area for the first color toner image on the photosensitive element to reduce potential of the image area thereby forming an electrostatic latent image for the first color toner image. The latent image is developed with a toner of the first color having the same polarity as the surface of the photosensitive element, so that a toner image of the first color is formed. Thereafter, charging and exposing are performed in the same manner on the photosensitive element on which the first color toner image is formed, thereby forming a latent image for a second color toner image. The latent image is developed with a toner of the second color in the same manner as the above procedure to form the second color toner image. This process is repeated for the number of colors of toner.

When developing a latent image for the second or later color toner image, an amount of toner that adheres to the surface of the photosensitive element is significantly different between an area on which a toner image has already been formed (hereinafter, toner-image formed area) and an area on which a toner image has not already been formed (hereinafter, non-toner-image formed area), which causes uneven density in a toner image to be developed.

One reason for this is that when forming a latent image by exposing the surface of the photosensitive element, potential (post-exposure potential) is not reduced in the toner-image formed area due to a charge amount of the toner image in the same manner as the non-toner-image formed area. This causes a development potential, which is a difference between the post-exposure potential and a development bias, to differ between the toner-image formed area and the non-toner-image formed area. Specifically, the development potential of the toner-image formed area is lower than that of the non-toner-image formed area by the amount of charges of the toner image. Therefore, the adhering amount of toner is different between the toner-image formed area and the non-toner-image formed area.

Japanese Patent Application Laid-open No. H08-286456 discloses an image forming apparatus in which a photosensitive element and a first color toner image on the photosensitive element are neutralized by a neutralizing unit during a period from when the toner image is developed on the photosensitive element until when the photosensitive element is charged again by a charging unit for forming a second color toner image of the next color. The neutralizing unit neutralizes the photosensitive element and the first color toner image by supplying charges having a polarity opposite to that for charging the photosensitive element and a toner image by the charging unit.

However, when the photosensitive element is charged by the charging unit for the second color toner image, the neutralized first color toner image is also charged to the same polarity again. Therefore, it is difficult to reduce the influence of the charges of the first color toner image on forming the second color toner image.

SUMMARY OF THE INVENTION

It is an object of the present invention to at least partially solve the problems in the conventional technology.

According to one aspect of the present invention, there is provided an image forming apparatus that includes an image carrier, a charging unit that charges a surface of the image carrier, a latent-image forming unit that forms a latent image for each color by exposing the surface of the image carrier charged by the charging unit, and a plurality of developing units that sequentially develops latent images formed on the image carrier with toners of different colors including at least cyan, yellow, and magenta, to form a color toner image on a single unit of the image carrier. The developing units further develops the latent images with toners of blue, green, and red, such that the toner images of different colors are not superimposed on a same position.

Furthermore, according to another aspect of the present invention, there is provided an image forming apparatus that includes an image carrier, a charging unit that charges a surface of the image carrier, a latent-image forming unit that forms a latent image for each color by exposing the surface of the image carrier charged by the charging unit, and a plurality of developing units that sequentially develops latent images formed on the image carrier with toners of different colors to form each of toner images of different colors on a single unit of the image carrier. The image forming apparatus includes a transfer body onto which a toner image of each color formed on the image carrier is transferred; and a transfer unit that transfers the toner image on the image carrier onto the transfer body, and the developing units develops the latent images to form a color toner image on the transfer body by repeating at least twice a toner-image forming process of forming a latent image on the image carrier, developing the latent image to form a toner image on the image carrier, and transferring the toner image onto the transfer body in a first mode so that the toner images of different colors are not superimposed on a same position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
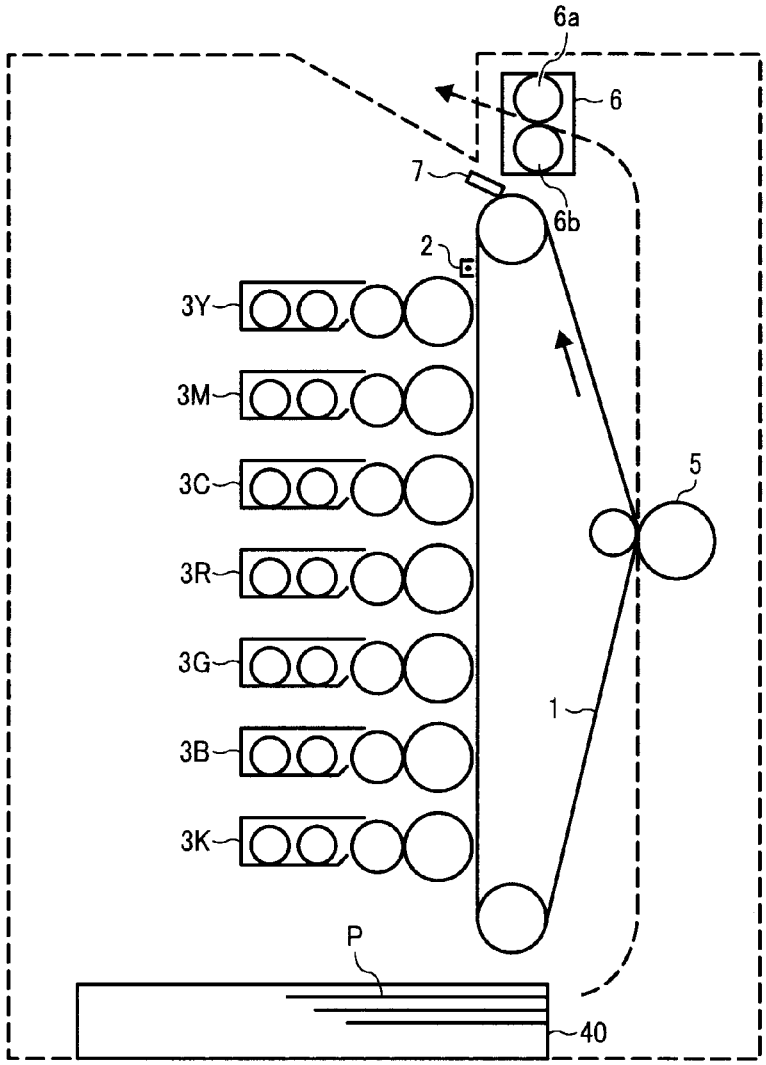
FIG. 1 is a schematic diagram of a copier according to a first embodiment of the present invention.

FIG. 1 is a schematic diagram of a copier as an image forming apparatus according to a first embodiment of the present invention. According to the copier shown in FIG. 1, a photosensitive belt 1 on which light emitting elements are provided over the inner side is arranged in the center; and a charging device 2, developing devices 3Y, 3M, 3C, 3R, 3G, 3B, and 3K for seven colors, a transfer device 5, and a cleaning device 7 are arranged on the circumference of the photosensitive belt 1. Although a photosensitive belt is used in the first embodiment, a photosensitive drum can be used without problem.

According to the first embodiment, a color image is formed from toner images of seven colors, namely, yellow (Y), magenta (M), cyan (C), red (R), green (G), blue (B), and black (K). A brief flow of the mechanism of forming a color image is explained below.

Figure 2:
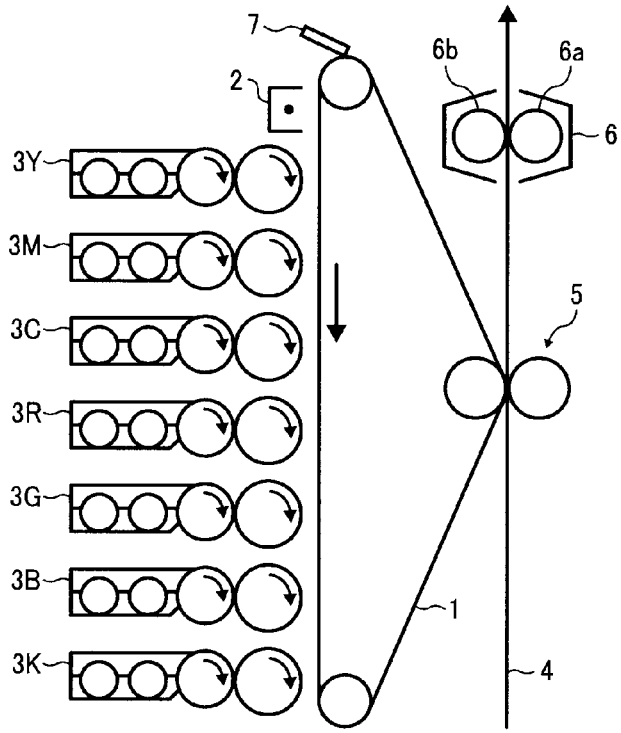
FIG. 2 is a schematic diagram illustrating the vicinity of a photosensitive belt of the copier shown in FIG. 1.

As shown in FIG. 2, the charging device 2 and developing devices 3Y, 3M, 3C, 3R, 3G, 3B, and 3K for seven colors are arranged in this order from upstream to downstream along the rotational direction of the photosensitive belt 1 (the direction of a short arrow in FIG. 1). A photosensitive belt surface is uniformly charged by the charging device 2. As described later, a transparent electrode layer and a light-emitting element layer are provided over the whole surface of the inner side of a photosensitive layer of the photosensitive belt 1. An electrostatic latent image corresponding to each color can be formed by exposing an image part to light from the backside of the photosensitive layer by a light emitting element (organic electroluminescence (EL) layer) included in the light-emitting element layer, based on input image data, in an associated manner with data for an output image created by performing image processing by an image processing device 112, which will be described later. An electrostatic latent image for yellow is formed at first, and developed by the developing device 3Y with a yellow toner, and a yellow toner image is formed on the photosensitive belt 1.

Processes of charging, exposing, and development, similar to those for yellow, are then repeatedly performed on the photosensitive belt 1 on which the yellow toner image is formed, with respect to each color of magenta, cyan, red, green, blue, and black, so that toner images of seven colors are formed on the photosensitive belt 1. The order of development is not limited to this.

When forming an image, a recording sheet P such as a sheet of paper sent along a sheet convey path 4 from a sheet feeder 40 shown in FIG. 1 is conveyed to a nip portion between the photosensitive belt 1 and the transfer device 5, and then the toner images formed on the photosensitive belt 1 are collectively transferred onto the recording sheet P through the nip portion with a voltage applied by the transfer device 5. When the recording sheet P reaches a fixing device 6, the toner images on the recording sheet P are fixed onto the recording sheet P by heat and pressure by being sandwiched between a heating roller 6*a* and a pressing roller 6*b*.

A toner that is not transferred and left on the photosensitive belt 1 (transfer-residual toner) is cleaned by the cleaning device 7.

Figure 3:
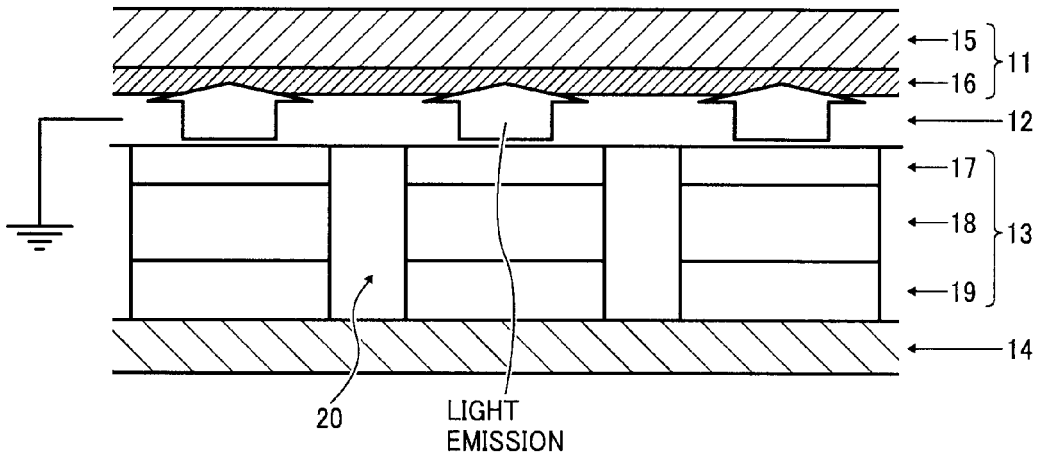
FIG. 3 is a cross-sectional view of the photosensitive belt.

FIG. 3 is a cross-sectional view of the photosensitive belt 1 configured to be used in the copier according to the first embodiment. According to the first embodiment, although an organic EL is used as a light emitting element, the light emitting element is not limited to this. The photosensitive belt 1 is not limited to a configuration shown in FIG. 3, and as long as light emitting elements are provided over the whole surface of the inner side of a photosensitive element, any kind of photosensitive element, for example, a photosensitive belt or a photosensitive drum, can be used.

The photosensitive belt 1 includes a photosensitive layer 11, a transparent electrode layer 12, a light-emitting element layer 13, and a substrate 14, in this order from the outer side. The photosensitive layer 11 includes a charge transport layer 15 and a charge generation layer 16. The transparent electrode layer 12 is grounded. The light-emitting element layer 13 includes a positive-hole transport layer 17, an organic EL layer (electron transport layer) 18, a driving electrode layer 19, and an isolation layer 20.

The driving electrode layer 19 controls a voltage pixel by pixel, and causes each pixel to emit light. For example, a thin film transistor (TFT) used in a general organic EL display device can be used as the driving electrode layer 19.

The photosensitive belt 1 configured as FIG. 3 forms an electrostatic latent image on a uniformly-charged photosensitive belt surface according to the following principle. Precisely, when the driving electrode layer 19 causes the organic EL layer 18 to emit light by applying a voltage, the emitted light reaches the charge generation layer 16, and generates a charge with reversed polarity against the charged polarity of the photosensitive belt surface. The generated charge moves through the charge transport layer 15 and reaches the photosensitive belt surface, and then reduces potential by neutralizing a charge on the photosensitive belt surface. Accordingly, an electrostatic latent image can be formed by reducing potential of only light-emitting pixels on the uniformly-charged photosensitive belt surface.

It is required that there is not isolation layer between the transparent electrode layer 12 and the charge generation layer 16. The reason for this is because generation of a charge on the charge generation layer 16 naturally results in generation of a charge with reversed polarity. If there is an isolation layer, the charge with reversed polarity cannot be released, as a result, the charges are recombined with each other, so that a required charge does not reach the photosensitive belt surface. For this reason, to release the charge with reversed polarity, the charge generation layer 16 needs to be in contact with an electrode that is grounded. According to FIG. 3, the transparent electrode layer 12 and the charge generation layer 16 are grounded; however, a kind of a conductive layer can be present as required.

Similarly, the positive-hole transport layer 17 also needs to be in contact with an electrode to supply a positive hole (positive charge). The transparent electrode layer 12 has the role of an electrode for both of the charge generation layer 16 and the positive-hole transport layer 17. Another configuration can be also feasible such that a transparent electrode layer for the charge generation layer 16 is separated from a transparent electrode layer for the positive-hole transport layer 17, and a transparent isolation layer is sandwiched between those transparent electrode layers.

Figure 4:
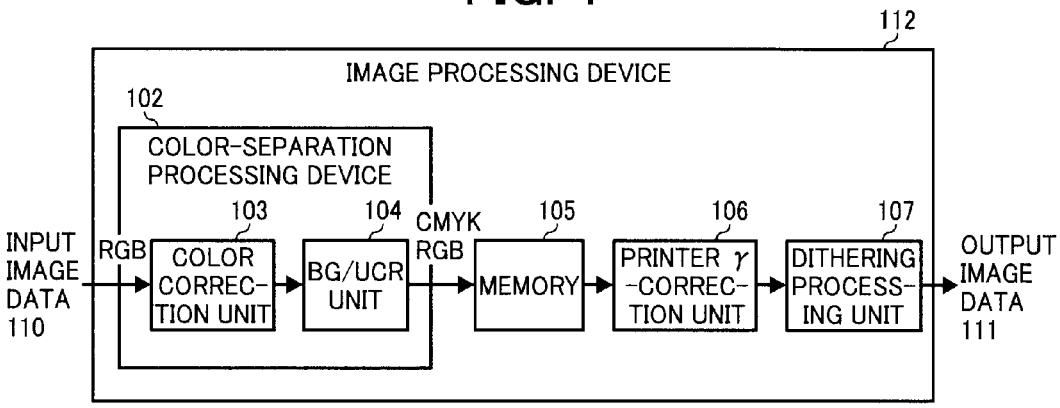
FIG. 4 is a functional block diagram of an image forming apparatus according to the first embodiment.

FIG. 4 is a functional block diagram of an image forming apparatus 112 according to the first embodiment. The image processing device 112 performs image processing on input image data 110 and converts it into output image data 111, and includes a color-separation processing device 102 that includes a color correction unit 103 and a black generation/under color removal (BG/UCR) unit 104, a memory 105, a printer γ-correction unit 106, and a dithering processing unit 107. According to FIG. 4, a digital image signal of the input image data 110 is an 8-bit color image signal for each color of RGB (hereinafter, an 8-bit based RGB color image signal), and converted into an 8-bit color image signal for each color of YMCRGBK (hereinafter, an 8-bit based YMCRGBK color image signal) by the color correction unit 103 and the BG/UCR unit 104 of the color-separation processing device 102.

Signals separated into seven colors by the color-separation processing device 102 are temporarily stored in the memory 105. Image signals stored in the memory 105 are then processed by the printer γ-correction unit 106 and the dithering processing unit 107. Any printer γ-correction unit and any dithering processing unit that are conventionally known can be applied to the present embodiment as the printer γ-correction unit 106 and the dithering processing unit 107.

Details of an operation mechanism according to the first embodiment are explained below with reference to FIG. 2. According to the first embodiment, it is assumed that an image is formed by rotating the photosensitive belt 1 in the direction of the arrow shown in FIG. 2.

The surface of the photosensitive belt 1 is uniformly charged to −500 volts by the charging device 2. The charging device 2 is not particularly limited, and any conventionally-known charging device can be used. An image part for yellow is then exposed to light from the backside of the photosensitive layer 11 (the inner side of a loop of the photosensitive belt) by the organic EL layer 18, and photosensitive-element surface potential of a light-exposed part is reduced to −100 volts. The surface potential of the light-exposed part is called post-exposure potential. In this way, an electrostatic latent image for yellow can be formed by reducing potential of only pixels corresponding to a yellow image to −100 volts on the photosensitive belt surface that is uniformly charged at −500 volts. Thereafter, the electrostatic latent image is developed with a yellow toner by the developing device 3Y, which is a non-contact type and will be described later and explained in detail, and then a yellow toner image is formed on the photosensitive belt 1.

A magenta toner image is then formed on the photosensitive belt 1 on which the yellow toner image has been formed, through processes of exposing and development similar to those for yellow.

According to the first embodiment, it is configured not to superimpose the magenta toner image on a pixel on which the yellow toner image is already formed, and not to superimpose toner images of the rest of the colors, namely, cyan, red, green, blue, and black, i.e., not to superimpose a toner image of a next color on a pixel on which there is a toner image of any previous color.

In this way, toner images of seven colors, namely, yellow, magenta, cyan, red, green, blue, and black, are formed on the photosensitive belt 1.

The toner images of seven colors are then transferred by the transfer device 5 collectively onto the recording sheet P having been conveyed via the sheet convey path 4. Finally, the fixing device 6 fixes the toner images onto the recording sheet P, so that the recording sheet P with a color image fixed thereon is output.

When forming toner images of more than one color on the photosensitive belt 1, there is a problem that formation of a toner image of a next color is sometimes disturbed by a toner image of a previous color, because it is intended to superimpose the toner image of the next color onto the toner image of the previous color. For this reason, it is difficult to stably output a high quality image.

EXAMPLE 1

According to Example 1, because a toner image of a next color is not formed on a pixel on which there is a toner image of any previous color, i.e., toner images of respective colors are not superimposed; the following problem can be avoided, and a high quality image can be output stably.

When superimposing a toner image of a next color on a pixel on which there is a toner image of a previous color on the photosensitive belt 1, a history of potential distribution corresponding to the toner image of the previous color has to be deleted. Unless deleting the history, the potential distribution history is reflected when forming a toner image of a next color, consequently, development amounts of the toner image of the next color vary between a pixel on which a toner image of a previous color is formed and a pixel on which no toner image of any previous color is formed. However, it is very difficult to charge the photosensitive belt surface uniformly again in the presence of a toner image of a previous color on the photosensitive belt surface. By contrast, according to Example 1, a toner image of a next color is not superimposed on a pixel on which there is a toner image of any previous color, as a result, the surface of the photosensitive belt does not need to be uniformly charged again.

Furthermore, there is a problem associated with toner-layer potential. The toner-layer potential means surface potential after exposing is sufficiently performed when there is a toner layer (a toner image) on the photosensitive belt 1 (equal to a voltage applied to the toner layer). Such surface potential is generated because a toner has a charge. Due to the toner-layer potential, depths of an electrostatic latent image vary between a part with a toner layer and a part without toner layer, even with the same light intensity. As a result, development amounts of a toner image of a next color vary between a pixel on which there is a toner image of a previous color and a pixel on which there is no toner image of any previous color. To solve the problem associated with toner-layer potential, the amount of electrostatic charge of toner images of the previous color on the photosensitive belt 1 has to be zero, however, it is very difficult. By contrast, according to the first embodiment, a toner image of a next color is not superimposed on a pixel on which there is a toner image of any previous color, therefore, toner-layer potential is not a problem.

According to the first embodiment, the developing devices 3, each of which is a non-contact type and will be explained later in detail, develop electrostatic latent images on the photosensitive belt 1 with toners of respective colors, and particularly perform so-called saturation development. As long as a developing device can perform saturation development, a similar effect can be expected, so that the developing device is not limited to the developing devices 3.

A potential difference between the post-exposure potential and the development potential of a developing device is called latent-image potential. An electrostatic latent image on the photosensitive belt 1 is developed with a toner charged to saturate the latent-image potential. When potential created by the charged toner on the photosensitive belt surface turns substantially equal to the development potential, the electrostatic latent image is not further developed with the toner, and it is considered that the electrostatic latent image is developed with a toner sufficient to the latent-image potential. Such phenomenon is called saturation development.

Figure 5:
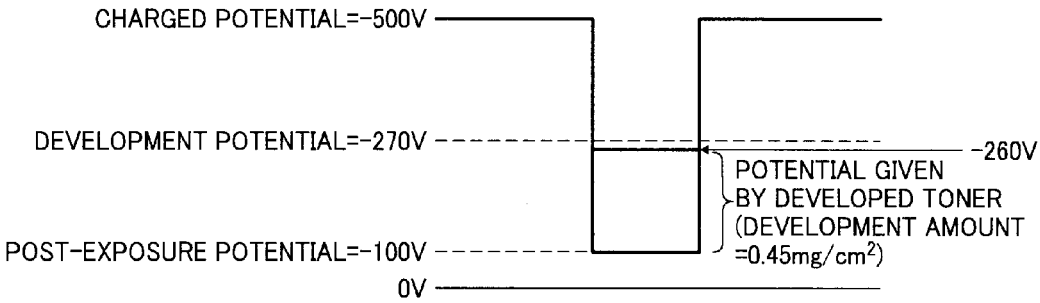
FIG. 5 is a schematic diagram for explaining values of potential on the photosensitive belt and a toner image surface in saturation development according to the first embodiment.

According to Example 1, it is assumed that the development potential is −270 volts, and the amount of electrostatic charge of a toner to be used for development is −25 μC/g. By using the toner, an electrostatic latent image on the photosensitive belt 1 of which the photosensitive layer 11 is 30 micrometers [μm] in thickness is developed. The electrostatic latent image is then developed with an amount of the toner adequate to generate approximately −260 volts by adding potential generated by a developed toner layer on the photosensitive belt surface and −100 volts of the post-exposure potential, and then the latent-image potential is substantially saturated. Such conditions are determined for a toner development amount to become approximately 0.45 mg/cm$^2$. The conditions are shown in FIG. 5.

As the saturation development described above is performed, the latent-image potential of pixels of a developed toner image of a color is saturated, so that a toner image of a next or later color is not developed on the pixels as long as development potential for the next or later color is smaller than −270 volts in the absolute value. Accordingly, charging for the second and later colors is not needed, therefore, the developing device is not required more than one. As described above, an image can be formed such that toner images of more than one color are not superimposed on any point at the same position on the photosensitive belt 1.

According to Example 1, although the charging device 2 is provided only one upstream of the developing device 3Y in the rotational direction of the photosensitive belt, charging devices can be used for respective colors in some cases. Although additional charging devices result in a high cost; even if saturation development is not adequate, a charging device provided for each color can avoid developing a toner image of a next color onto a pixel on which there is a toner image of a previous color. According to Example 1, although an electrostatic latent image is developed by using a negatively-charged toner by negatively charging the photosensitive belt surface by the charging device 2, an electrostatic latent image can also be developed by using a positively-charged toner by positively charging the photosensitive belt surface.

When using toners of only four colors, namely, yellow, magenta, cyan, and black, similarly to a typical image forming apparatus; if an image is formed such that toner images of more than one color are not superimposed on any point (pixel) at the same position on the photosensitive belt 1, and directly transferred and fixed onto a sheet; only an image having narrow color reproducibility is output.

For this reason, according to the first embodiment, an image is to be formed with seven color toners in total, by adding red, green, and blue toners to four color toners of yellow, magenta, cyan, and black. According to a typical image forming apparatus, a toner image of red is formed by superimposing magenta and yellow, a toner image of green is formed by superimposing yellow and cyan, and a toner image of blue is formed by superimposing cyan and magenta. In other words, according to the first embodiment, by preliminarily providing red, green, and blue toners that are conventionally reproduced by superimposing toners of more than one color, a toner image conventionally obtained by superimposing the toners of the more than one color can be formed without superimposing the toners of the more than one color on the same position. Accordingly, sufficient color reproducibility can be achieved even in an image that toner images of more than one color are not superimposed on any point at the same position. The number of colors can be decreased or increased from seven colors in some cases. The number of colors can be determined in accordance with to what extent a customer requires color reproducibility.

Figure 6:
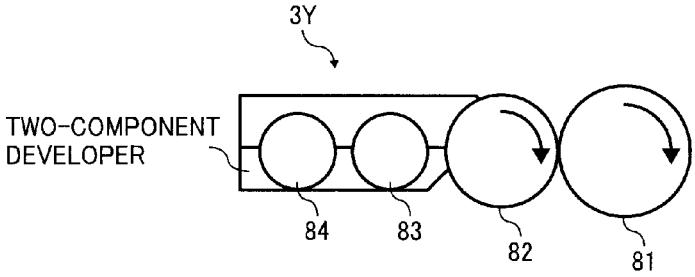
FIG. 6 is a schematic diagram of a developing device in Example 1 of the first embodiment.

The developing devices 3Y, 3M, 3C, 3R, 3G, 3B, and 3K used in Example 1 are explained below. According to Example 1, because a toner image of a next color is developed under a state that toner images of the previous colors are present on the photosensitive belt surface, the developing devices 3 of a non-contact type are used to prevent the toner images of the previous colors from being disturbed when developing the toner image of the next color. The developing device 3Y according to Example 1 is shown in FIG. 6. The rest of the developing devices 3M, 3C, 3R, 3G, 3B, and 3K are also the same, therefore, the developing device 3Y is explained below as a representative of them.

The developing device 3Y includes a toner carrying roller 81, a mug roller 82, and a case that accommodates a two-component developer and string screws 83 and 84. Except the toner carrying roller 81, the developing device 3Y is similar to a developing device of a typical two-component developing method. The two-component developer is made of a magnetic carrier powder mixed with a toner at about 6 wt %. The two-component developer is conveyed to the toner carrying roller 81 by the mug roller 82 that includes a permanent magnet its inside, and then part of the toner is transferred onto the toner carrying roller 81 with applied bias potential. The toner transferred onto the toner carrying roller 81 forms a cloud (a state in which a toner is floating) according to a principle explained below, and is carried to a development part (an opposite part against the photosensitive belt 1) by a rotation of the toner carrying roller 81.

A toner image is formed owing to a difference between an average potential of a toner carrying-roller surface and an image-carrier potential, and a redundant toner that does not contribute to development is returned to the mug roller 82. Because the cloud is formed, the adhesion of the toner is very low, so that the toner returned via the toner carrying roller 81 from the development part is easily scratched out or flattened with spikes of the two-component developer following to the rotation of the mug roller 82. By repeating this, a certain amount of toner is constantly carried on the toner carrying roller 81 as a cloud. Although the two-component development method is employed as a toner supply method to the toner carrying roller 81, a configuration of the developing device is not limited to this.

Figure 7:
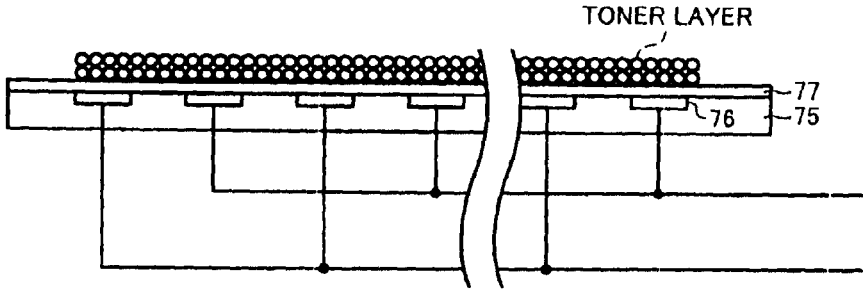
FIG. 7 is a schematic diagram of a surface of a toner carrying roller shown in FIG. 6 in Example 1.

FIG. 7 is a schematic diagram of a surface of the toner carrying roller 81. Aluminum deposition electrodes 76 that are spatially cyclical are arranged on a supporting base 75, and the surface of the supporting base 75 is covered with a resin coat 77.

Figure 8:
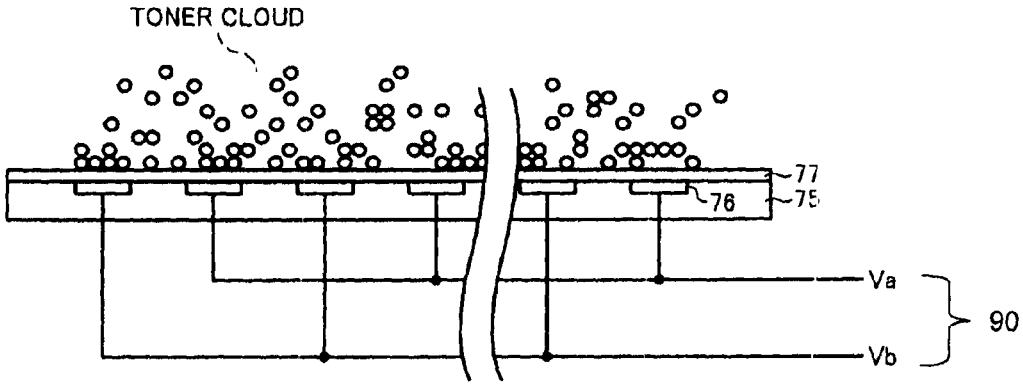
FIG. 8 is a schematic diagram illustrating a toner cloud when different-waveform voltages are alternately applied to cyclically arranged electrodes shown in FIG. 7.
Figure 9:
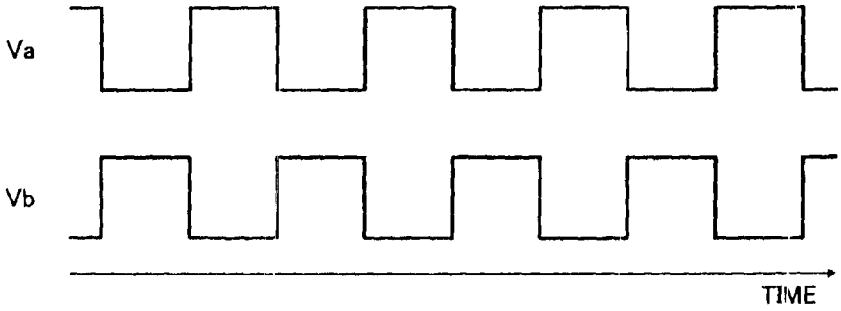
FIG. 9 is a schematic diagram of waveforms of voltages applied to the cyclically arranged electrodes shown in FIG. 8.

As shown in FIG. 8, a voltage Va and a voltage Vb that have different waveforms are applied, by a hopping-electric-field generating unit 90 for example, alternately to the cyclical electrodes. Va and Vb are temporally in opposite phase (phase is shifted by 180 degree) as shown in FIG. 9. Accordingly, an oscillating electric filed is formed between the respective electrodes applied with Va and Vb. Consequently, a toner is hopping between the electrodes applied with Va and the electrodes applied with Vb, thereby forming a cloud. In this way, a toner can be carried on the toner carrying roller 81 as a cloud. Although Va and Vb are shown as a rectangular wave in FIG. 9, those can be a typical alternating voltage formed of a sine wave. Although the cyclical electrodes are divided into two in Example 1, and alternately applied with voltages of different waveforms, the cyclical electrodes can be divided into three or more, and applied with respective different-waveform voltages, as long as conditions satisfy that an oscillating electric field can be formed and a toner can form a cloud by hopping.

According to Example 1, it is assumed that Va and Vb are applied with a voltage that includes an alternating-current component of a rectangular wave having 600 volts of peak-to-peak voltage and one kilohertz of frequency, and a direct-current component of −270 volts that is superimposed. A development bias to be a trigger for development with a toner to an electrostatic latent image in a development area is a temporal average of the voltage. In other words, the development bias is −270 volts.

Because according to the development method, development is performed by forming a cloud, an influence of the adhesion between the toner carrying roller 81 and a toner can be made small. As a result, if conditions satisfy that a toner is sufficiently conveyed to the development area, the development ends when photosensitive element potential (post-exposure potential) under a state that a toner is adhered to the photosensitive belt 1 becomes substantially equal to the development potential. In other words, saturation development can be easily performed. When an adhesion between a toner and the toner carrying roller 81 is very small, development can be performed in accordance with latent-image potential of pixels exposed to light, so that a high quality image can be output stably.

EXAMPLE 2

A general configuration of an image forming apparatus according to Example 2 is the same as that of Example 1, and is shown in FIG. 1. An operation of the image forming apparatus is also similar to Example 1.

A difference between Example 2 and Example 1 is the developing devices 3Y, 3M, 3C, 3R, 3G, 3B, and 3K. All of the developing devices 3 are the same, therefore the developing device 3Y is explained below as a representative of them.

Figure 10:
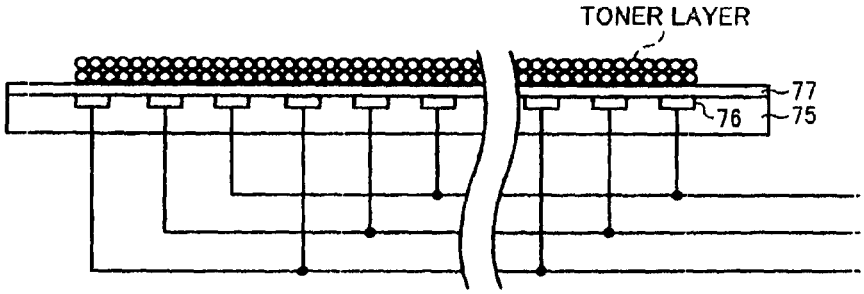
FIG. 10 is a schematic diagram of a surface of a toner carrying roller in Example 2.

The developing device 3Y according to Example 2 is shown in FIG. 6, and has a substantially similar shape to the developing device 3Y according to Example 1. A difference is in the toner carrying roller 81. As shown in FIG. 10, the aluminum deposition electrodes 76 that are spatially cyclical are arranged on the supporting base 75, and the surface of the supporting base 75 is covered with the resin coat 77.

Figure 11:
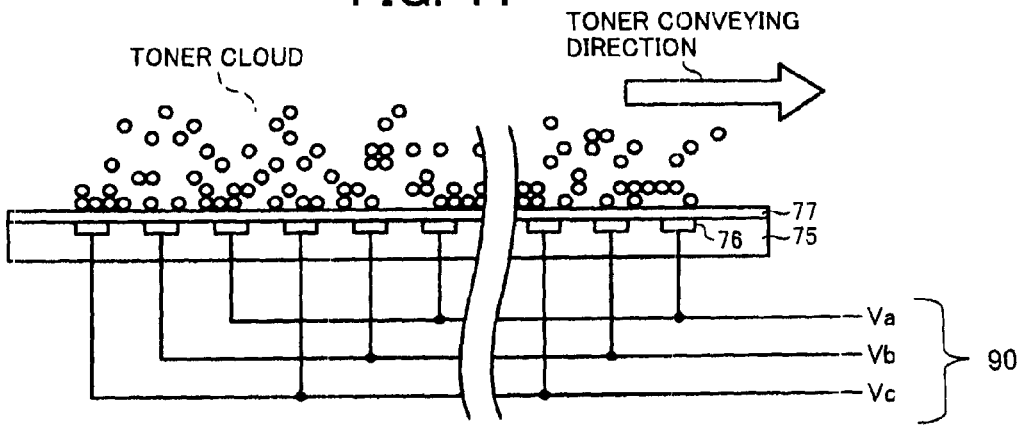
FIG. 11 is a schematic diagram illustrating a toner cloud when different-waveform voltages are applied to cyclically arranged electrodes shown in FIG. 10.

According to Example 2, the cyclical electrodes are divided into three as shown in FIG. 10 (dividing into three in this case, however, it can be more), and then a voltage Va, a voltage Vb, and a voltage Vc that have different waveforms are applied to respective cyclical electrodes as shown in FIG. 11. Consequently, similarly to Example 1, a toner is hopping between the electrodes applied with Va, the electrodes applied with Vb, and the electrode applied with Vc, thereby forming a cloud.

Figure 12:
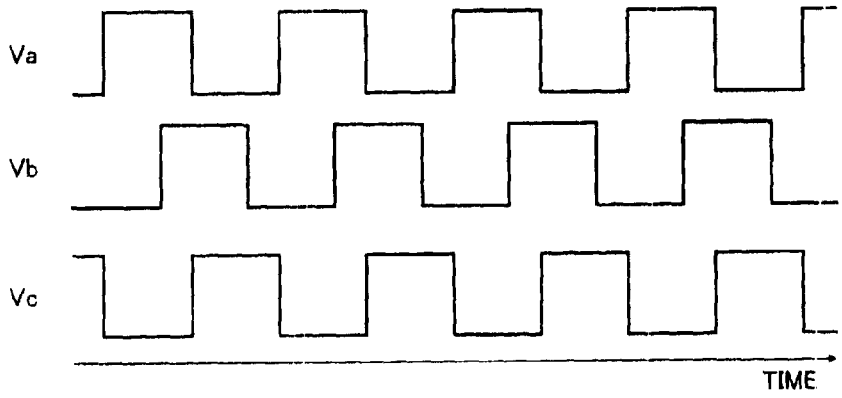
FIG. 12 is a schematic diagram of waveforms of voltages applied to the cyclically arranged electrodes shown in FIG. 11.

As shown in FIG. 12, a traveling-wave electric field through which the toner is conveyed is also generated by appropriately shifting the phases of Va, Vb, and Vc, thereby conveying the toner. Accordingly, the toner in a cloud can be conveyed to the development part without mechanically rotating the toner carrying roller 81.

According to Example 2, it is assumed that Va and Vb are applied with a voltage that includes an alternating-current component of a rectangular wave having 600 volts of peak-to-peak voltage and one kilohertz of frequency, and a direct-current component of −270 volts that is superimposed. A development bias to be a trigger for development with a toner to an electrostatic latent image in a development area is a temporal average of the voltage. In other words, the development bias is −270 volts.

Because development is performed by forming a cloud in the above development method, an influence of the adhesion between the toner carrying roller 81 and a toner can be made small. Accordingly, the toner can respond to even a small development electric field in the development area. As a result, if conditions satisfy that a toner is sufficiently conveyed to the development area, the development ends when photosensitive element potential (post-exposure potential) under a state that a toner is adhered to the photosensitive belt 1 becomes substantially equal to the development potential. In other words, saturation development can be easily performed. When an adhesion between a toner and the toner carrying roller 81 is very small, development can be performed in accordance with latent-image potential of pixels exposed to light, so that a high quality image can be output stably.

Figure 13:
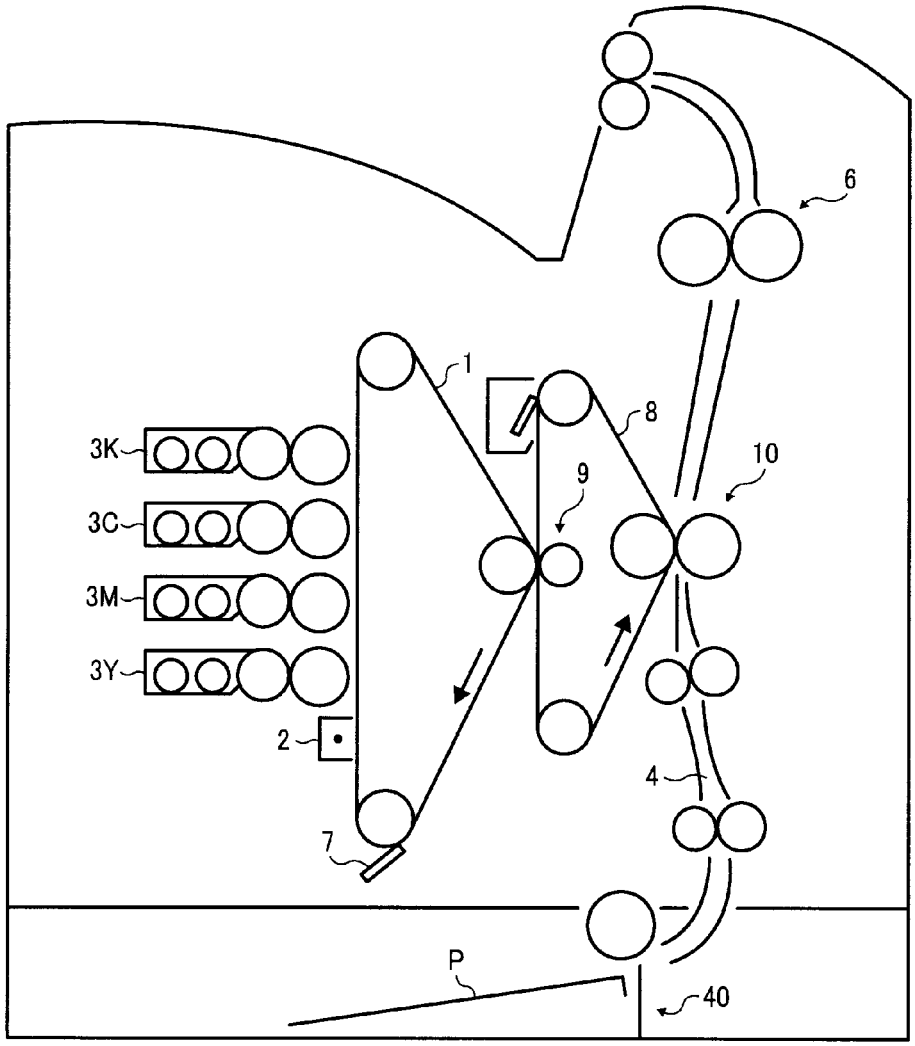
FIG. 13 is a schematic diagram of a printer according to a second embodiment of the present invention.

A color laser printer (hereinafter, "printer") as an image forming apparatus according to a second embodiment of the present invention is explained below with reference to FIG. 13. FIG. 13 is a schematic diagram of the printer according to the second embodiment. As shown in FIG. 13, the printer includes the photosensitive belt 1 as an image carrier that is supported by a plurality of supporting rollers, and light emitting elements are provided over the whole surface of the inner side of the photosensitive belt 1. The photosensitive belt 1 used in the second embodiment is similar to that used in the first embodiment, and a cross-sectional view of its configuration is FIG. 3, therefore explanation of it is omitted. The photosensitive belt 1 is rotationally driven clockwise as indicated by an arrow A in FIG. 13; and the charging device 2, the developing devices 3Y, 3M, 3C, and 3K for four colors, an intermediate transfer belt 8, and the cleaning device 7 are arranged around the photosensitive belt 1. Although the printer according to the second embodiment uses a photosensitive belt as an image carrier, a photosensitive drum can be used without problem.

According to the second embodiment, a color image is formed from toner images of four colors, namely, yellow (Y), magenta (M), cyan (C), and black (K). A brief flow of the mechanism of forming a color image is explained below.

Figure 14:
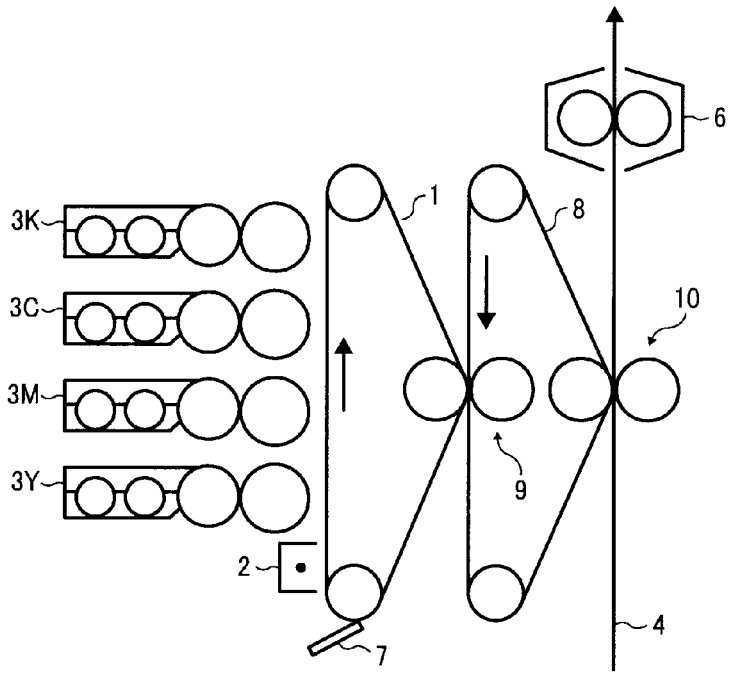
FIG. 14 is a schematic diagram illustrating the vicinity of a photosensitive belt of the printer shown in FIG. 13 according to the second embodiment.

FIG. 14 is a schematic diagram illustrating the vicinity of the photosensitive belt 8. According to FIG. 14, the charging device 2 and the developing devices 3 of four colors are arranged in order of yellow, magenta, cyan, and black, from upstream to downstream along the rotational direction of the photosensitive belt 1 (the direction of an arrow in FIG. 14). The photosensitive belt surface is uniformly charged by the charging device 2. As explained in the first embodiment, the transparent electrode layer and the light-emitting element layer are provided over the whole surface of the inner side of the photosensitive layer of the photosensitive belt 1. An electrostatic latent image corresponding to each color is formed by exposing an image part to light from the backside of the photosensitive layer 11 by the organic EL layer 18 (light emitting elements) included in the light-emitting element layer 13, based on input image data, in an associated manner with data for an output image created by performing image processing by an image processing device 132, which will be described later. The electrostatic latent image for each color is developed and visualized by the developing device 3 of each color with a toner of each color, so that a toner image of each color is formed.

The processes are repeated with respect to each color of yellow, magenta, cyan, and black, so that toner images of four colors are formed on the photosensitive belt 1. According to the second embodiment, an image including toner images of four colors to be formed on the photosensitive belt 1 is formed such that the toner images of respective colors are not superimposed on any point (pixel) at the same position on the photosensitive belt 1. This will be described later and explained in detail.

Figure 15:
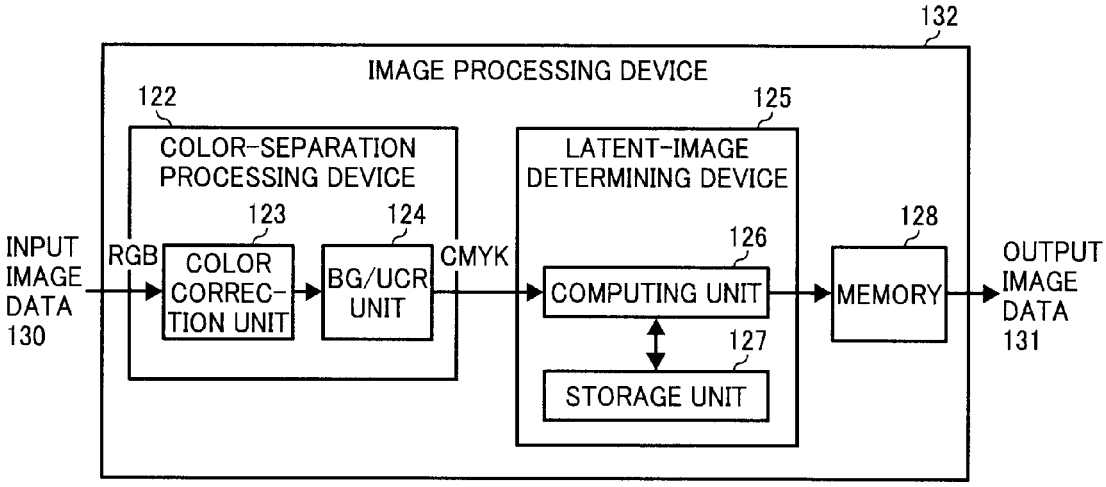
FIG. 15 is a functional block diagram of an image forming apparatus according to the second embodiment.

FIG. 15 is a functional block diagram of the printer. The image processing device 132 performs image processing on input image data 130 and converts it into output image data 131, and includes a color-separation processing device 122 that includes a color correction unit 123 and a BG/UCR unit 124, a latent-image determining device 125 that includes a computing unit 126 and a storage unit 127, and a memory 128. According to FIG. 15, a digital image signal of the input image data 130 is an 8-bit based RGB color image signal, and converted into an 8-bit based YMCRGBK color image signals by the color correction unit 123 and the BG/UCR unit 124 of the color-separation processing device 122.

The latent-image determining device 125 performs processing on signals separated into four colors by the color-separation processing device 122, and creates writing-data of electrostatic latent images for respective colors to be written onto the photosensitive belt 1, and then the memory 128 stores therein the writing-data.

The processing performed by the latent-image determining device 125 is explained below. The computing unit 126 determines whether there are superimposed colors in the same one pixel based on color image signals separated into YMCK colors by the color-separation processing device 122. In accordance with the determination, if there are superimposed colors in the same one pixel, the following processing is to be performed. To explain an example simply, a case where the color Y and the color M are superimposed in the same one pixel is explained below. It is assumed that one pixel includes a matrix of 16 dots of four by four.

When the color Y and the color M are superimposed in the same one pixel, dithering processing is performed with respect to each of the color Y and the color M at first, and then a dot pattern of each color is created. It is then determined whether the sum of the number of dots of respective dot patterns of the color Y and the color M in the same one pixel is more than 16 dots. If the sum is more than 16 dots, the one pixel includes a part in which the dot pattern of the color Y and the dot pattern of the color M need to be superimposed. Therefore, the color Y and the color M of the one pixel are not formed on the photosensitive belt 1, and electrostatic latent images for respective colors are separately formed through a plurality of rounds of an image forming process. By contrast, if the sum is not more than 16 dots, the dot pattern of the color Y and the dot pattern of the color M can be formed without superimposing them in the one pixel. In other words, as an arrangement pattern is formed such that the dot pattern of the color Y and the dot pattern of the color M can be included within a matrix of 16 dots, the dot pattern of the color Y and the dot pattern of the color M can be formed in the one pixel without superimposing them. For this reason, according to the second embodiment, the storage unit 127 stores therein as a database an arrangement pattern of dot patterns of respective colors formed in the same one pixel in accordance with a combination of the numbers of dots of dot patterns of respective colors in the same one pixel. Accordingly, when the sum is not more than 16 dots, the computing unit 126 accesses the storage unit 127, and acquires an arrangement pattern corresponding to a combination of the number of dots, and the computing unit 126 determines an electrostatic latent image to be formed on the photosensitive belt 1 based on the arrangement pattern.

By contrast, when colors in the same one pixel are separately formed on the photosensitive belt 1 through a plurality of rounds of the image forming process as described above, latent images for respective colors are formed in respective rounds of the image forming process in the order that is preliminarily determined in accordance with a combination of colors to be superimposed. When forming the latent images, an arrangement pattern of a dot pattern when forming only one color in a pixel is acquired from the database in the storage unit 127 with respect each color, and the computing unit 126 determines an electrostatic latent image to be formed on the photosensitive belt 1 based on the arrangement pattern.

The computing unit 126 determines whether there is a color that is superimposed on any other color in the same one pixel based on color image signals. If there is no color that is superimposed on any other color in the same one pixel; dithering processing is performed with respect to the color, a dot pattern is created, an arrangement pattern of a dot pattern when forming only one color in a pixel is acquired from the database in the storage unit 127, and then the computing unit 126 determines an electrostatic latent image to be formed on the photosensitive belt 1 based on the arrangement pattern.

Image processing performed by the image processing device 132 is not limited the method described above, and can be any method according to which toner images of respective colors can be formed without superimposing the toner images on any point at the same position on the photosensitive belt 1.

According to the second embodiment, similarly to the first embodiment, a toner image of a next color is not formed on a pixel on which there is another toner image on the single photosensitive belt 1, i.e., toner images of respective colors are not superimposed on any point at the same position on the single photosensitive belt 1, so that the following problem can be avoided, and a high quality image can be stably output.

In other words, when superimposing a toner image of a next color on a pixel on which there is a toner image of a previous color on the photosensitive belt 1, a history of potential distribution corresponding to the toner image of the previous color has to be deleted. Unless deleting the history, the potential distribution history is reflected when forming a toner image of a next color, consequently, development amounts of the toner image of the next color vary between a pixel on which a toner image of a previous color is formed and a pixel on which no toner image of any previous color is formed. However, it is very difficult to charge the photosensitive belt surface uniformly again in the presence of a toner image of a previous color on the photosensitive belt surface. By contrast, according to the second embodiment, a toner image of a next color is not superimposed on a pixel on which there is a toner image of any previous color, as a result, the surface of the photosensitive belt does not need to be uniformly charged again.

Furthermore, there is a problem associated with toner-layer potential. The toner-layer potential means surface potential after exposing is sufficiently performed when there is a toner layer (a toner image) on the photosensitive belt 1 (equal to a voltage applied to the toner layer). Such surface potential is generated because a toner has a charge. Due to the toner-layer potential, depths of an electrostatic latent image vary between a part with a toner layer and a part without toner layer, even with the same light intensity. As a result, development amounts of a toner image of a next color vary between a pixel on which there is a toner image of a previous color and a pixel on which there is no toner image of any previous color. To solve the problem associated with toner-layer potential, the amount of electrostatic charge of toner images of the previous color on the photosensitive belt 1 has to be zero, however, it is very difficult. By contrast, according to the second embodiment, a toner image of a next color is not superimposed on a pixel on which there is a toner image of any previous color, therefore, toner-layer potential is not a problem.

The printer according to the second embodiment has a fast-operation mode and a slow-operation mode related to the following two manners of image forming.

At first, the fast-operation mode is explained below. Toner images of four colors formed on the photosensitive belt 1 are transferred by a primary transfer device 9 collectively onto the intermediate transfer belt 8. The toner images of four colors on the intermediate transfer belt 8 are then directly transferred by a secondary transfer device 10 collectively onto the recording sheet P having been conveyed along the sheet convey path 4. The toner images transferred collectively onto the recording sheet P are then fixed on the recording sheet P by the fixing device 6, consequently, a color image is output. The color image output in this way is an image in that two or more colors from among the toner images of respective colors are not superimposed on any point (pixel) at the same position on the recording sheet P.

According to the fast-operation mode, to avoid forming toner images of two or more colors in a superimposed manner on a point at the same position on the photosensitive belt 1, an electrostatic latent image for a predetermined color is formed on the point such that only a toner image of the predetermined color is to be formed, after the predetermined color is priorly determined in accordance with a combination of colors of toner images of two or more colors that can be superimposed on the point based on color image signals from the color-separation processing device 122. For example, in a case of a combination of cyan and magenta to be superimposed on the point, it is preliminarily set to form a toner image only with cyan. When cyan and magenta are superimposed on the point based on color image signals from the color-separation processing device 122, the latent-image determining device 125 determines to form an electrostatic latent image for cyan on the point. Based on the determination result, an electrostatic latent image for cyan is then formed by exposing the point on the photosensitive belt 1 to light by the organic EL layer 18 in accordance with the output image data 131, and then the electrostatic latent image is visualized with a cyan toner.

According to the fast-operation mode, the photosensitive belt 1 and the intermediate transfer belt 8 are operated at the same speed, so that a color image formed of toner images of four colors can be output fast. However, when forming an image in that two or more colors from among toner images of respective colors are not superimposed on any point (pixel) at the same position on the recording sheet P by using only four colors, namely, yellow, magenta, cyan, and black, the image has a color reproducibility substantially narrower than that achieved by a typical image forming apparatus that forms an image by superimposing two or more colors from among toner images of respective colors on a point at the same position on the recording sheet P.

Then, the slow-operation mode is explained below. After toner images of four colors formed on the photosensitive belt 1 are transferred by the primary transfer device 9 collectively onto the intermediate transfer belt 8, toner images of four colors are formed on the photosensitive belt 1 once more. The intermediate transfer belt 8 rotates once more while carrying the toner images of four colors transferred from the photosensitive belt 1, which is formed in the first round on the photosensitive belt 1. The toner images of four colors formed in the second round on the photosensitive belt 1 are then transferred by the primary transfer device 9 to be superimposed on the toner images of four colors of the first round on the intermediate transfer belt 8. Accordingly, a color image can be formed of which a part includes superimposed colors of two colors at maximum on the same position (pixel) on the intermediate transfer belt 8 (an image with 200% of so-called total amount control). In other words, a final color image is formed through two rounds of the process in a separated manner. The color image of which a part includes superimposed colors of two colors at maximum on the same position (pixel) on the intermediate transfer belt 8 is then transferred by the secondary transfer device 10 collectively onto the recording sheet P having been conveyed along the sheet convey path 4. The recording medium is then conveyed to the fixing device 6 at which the color image is fixed to the recording medium, and the recording medium with the color image fixed thereto is output.

According to the slow-operation mode, when forming a final color image through two rounds of a process in a separated manner, to avoid forming toner images of two colors in a superimposed manner on a point at the same position on the photosensitive belt 1, it is configured to form one toner image on the point on the photosensitive belt 1 in the first round of the image forming process from among the toner images of the two colors that can be superimposed on the point, and then to form the other toner image in the second round of the image forming process on the point on the photosensitive belt 1. For example, when forming a blue toner image by superimposing a cyan toner image and a magenta toner image on the intermediate transfer belt 8, based on color image signals from the color-separation processing device 122, the latent-image determining device 125 determines to form an electrostatic latent image for cyan on the point on the photosensitive belt 1 in the first round of the image forming process, and then to form an electrostatic latent image for magenta on the point on the photosensitive belt 1 in the second round of the image forming process. The point on the photosensitive belt 1 is exposed to light by the organic EL layer 18 in the first and second rounds of the image forming process based on the output image data 131 obtained based on a result of the determination, electrostatic latent images for respective colors are formed and visualized with respective color toners.

The color image is formed of toner images of which a part includes superimposed colors of two colors at maximum on the same position (pixel) (an image with 200% of so-called total amount control), therefore, sufficient color reproducibility can be expressed compared with the first output image. However, because the color image is formed by rotating the photosensitive belt 1 and the intermediate transfer belt 8 twice, output is slow. Furthermore, in some cases, an operation of forming a color image formed of toner images of which a part includes superimposed colors of three colors at maximum on the same position (pixel) (an image with 300% of so-called total amount control) can be performed by rotating the photosensitive belt 1 and the intermediate transfer belt 8 three times.

In this way, the printer according to the second embodiment includes two operational modes, namely, the fast-operation mode for outputting a color image with narrow color reproducibility at a high speed, and the slow-operation mode for outputting a color image with wide color reproducibility at a low speed; and is configured to form a color image by switching the fast-operation mode and the slow-operation mode arbitrarily, for example, by a user operating an operation panel (not shown) on the copier.

The printer according to the second embodiment can output as a color image a document that is created in, for example, a word-processing software program, and includes basic characters written in black and a highlighted part written with characters in red, through the following process.

To begin with, through the first rotation of the photosensitive belt 1, a black toner image is formed in a part corresponding to black characters on the photosensitive belt 1, and, for example, a magenta toner image, is formed in a part corresponding to red characters on the photosensitive belt 1. The black toner image and the magenta toner image are formed not to be superimposed. After the black toner image and the magenta toner image are transferred collectively onto the intermediate transfer belt, a yellow toner image to be superimposed on the magenta toner image to form a red toner image is formed in the part corresponding to the red characters on the photosensitive belt 1 through the second rotation of the photosensitive belt 1. The yellow toner image on the photosensitive belt 1 is then transferred to be superimposed on the magenta toner image that has been transferred onto the intermediate transfer belt 8. Accordingly, the document can be output as a color image including the black toner image and the red toner image. In other words, according to the image forming apparatus of the second embodiment, when outputting the document as a color image, the transfer of toner images from the photosensitive belt 1 to the intermediate transfer belt 8 is performed twice.

An image forming apparatus that has been conventionally known is such that only a toner image of one color is formed on a photosensitive belt and transferred onto a intermediate transfer belt, the similar process is then repeated on the same photosensitive belt with respect to each of the other colors, and toner images of more than one color are superimposed on the intermediate transfer belt, consequently a color image is output. When such typical image forming apparatus outputs the above document as a color image, the transfer of toner images from the photosensitive belt onto the intermediate transfer belt needs to be repeated three times (once each for a black toner image, a magenta toner image, and a yellow toner image).

Therefore, the printer according to the second embodiment can reduce the number of times of transfer of a toner image from the photosensitive belt 1 to the intermediate transfer belt to fewer than the typical image forming apparatus, and can output a color image of the document in a shorter time correspondingly.

EXAMPLE 3

Figure 16:
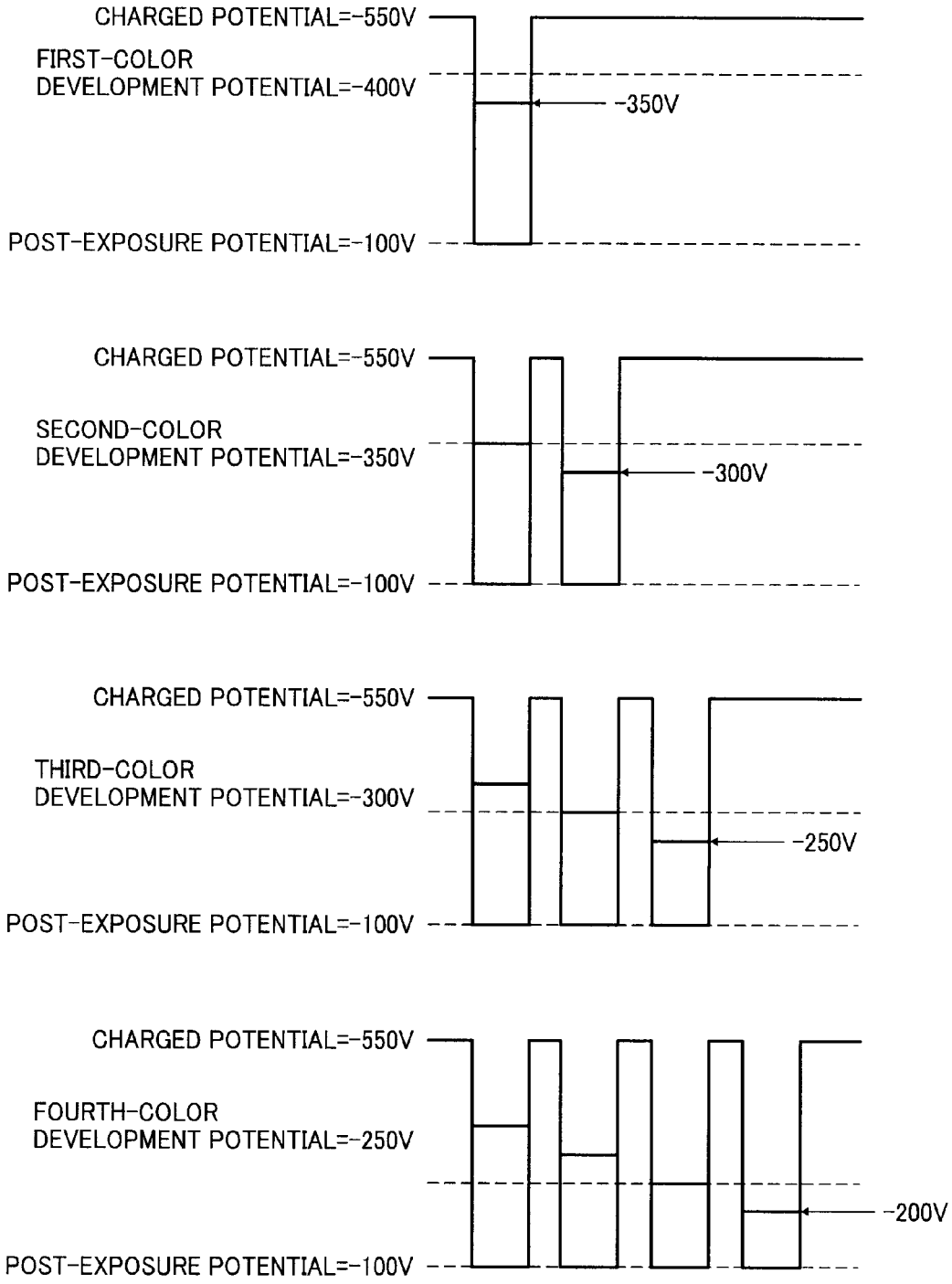
FIG. 16 is a schematic diagram for explaining values of potential on a photosensitive belt and a toner image surface in Example 4.

A process of forming toner images of more than one color on the photosensitive belt 1 is explained below with reference to FIG. 16.

To begin with, the surface of the photosensitive belt 1 is uniformly charged to −500 volts by the charging device 2. The charging device 2 is not particularly limited, and any conventionally-known charging device can be used. The photosensitive belt 1 uniformly charged by the charging device 2 is then exposed to light from the backside of the photosensitive layer 11 (the inner side of the photosensitive belt loop) by the organic EL layer 18 with respect to an image part for yellow, and photosensitive-element surface potential of a light-exposed part of is reduced (smaller in the absolute value) to −100 volts. The surface potential of the light-exposed part is called post-exposure potential. In this way, an electrostatic latent image for yellow can be formed by reducing potential of only pixels corresponding to a yellow image to −100 volts on the photosensitive belt surface that is uniformly charged at −500 volts. After that, the electrostatic latent image is developed by the developing device 3Y with a yellow toner, and then a yellow toner image is formed on the photosensitive belt 1.

A magenta toner image is then created on the photosensitive belt 1 on which the yellow toner image has been formed, through processes of exposing and development similar to those for yellow.

According to Example 3, it is configured not to superimpose the magenta toner image on a pixel on which the yellow toner image is already formed, and not to superimpose toner images of the rest of the colors, namely, cyan and black, i.e., not to superimpose a toner image of a next color on a pixel on which there is a toner image of any previous color.

In this way, toner images of four colors, namely, yellow, magenta, cyan, and black, are formed on the photosensitive belt 1.

The developing devices 3Y, 3M, 3C, and 3K used in Example 3 are a non-contact type, and similar to the developing devices shown in FIG. 6 and explained in Examples 1 and 2 according to the first embodiment, therefore details explanations are omitted.

According to Example 3, the developing devices 3 of a non-contact type develop electrostatic latent images on the photosensitive belt 1 with toners of respective colors, and particularly perform so-called saturation development. As long as a developing device can perform saturation development, a similar effect can be expected, so that the developing device is not limited to the developing devices 3.

Saturation development is explained below. A potential difference between post-exposure potential and development potential of a developing device is called latent-image potential. An electrostatic latent image on the photosensitive belt 1 is developed with a toner charged to saturate the latent-image potential. When potential created by the charged toner on the photosensitive belt surface turns substantially equal to the development potential, the electrostatic latent image is not further developed with the toner, and it is considered that the electrostatic latent image is developed with a toner sufficient to the latent-image potential. Such phenomenon is called saturation development.

According to Example 3, it is assumed that the development potential is −270 volts, and the amount of electrostatic charge of a toner to be used for development is −25 μC/g. By using the toner, an electrostatic latent image on the photosensitive belt 1 of which the photosensitive layer 11 is 30 μm in thickness is developed. The electrostatic latent image is then developed with an amount of the toner adequate to generate approximately −260 volts by adding potential generated by a developed toner layer on the photosensitive belt surface and −100 volts of the post-exposure potential, and then the latent-image potential is substantially saturated. Such conditions are determined for a toner development amount to become approximately 0.45 mg/cm$^2$ (see FIG. 5).

As the saturation development described above is performed, the latent-image potential of pixels of a developed toner image of a color is saturated, so that a toner image of a next or later color is not developed on the pixels as long as development potential for the next or later color is smaller than −270 volts in the absolute value. Accordingly, charging for the second and later colors is not needed, therefore, the developing device is not required more than one. As described above, an image can be formed such that toner images of more than one color are not superimposed on any point at the same position on the photosensitive belt 1.

According to Example 3, although only one charging device 2 is provided upstream of the developing device 3Y in the rotational direction of the photosensitive belt, charging devices can be used for respective colors in some cases. Although additional charging devices result in a high cost; even if saturation development is not adequate, a charging device provided for each color can avoid developing a toner image of a next color onto a pixel on which there is a toner image of a previous color. According to Example 3, although an electrostatic latent image is developed by using a negatively-charged toner by negatively charging the photosensitive belt surface by the charging device 2, an electrostatic latent image can also be developed by using a positively-charged toner by positively charging the photosensitive belt surface.

Because the developing devices 3 perform development by forming a cloud, an influence of the adhesion between the toner carrying roller 81 and a toner can be made small. Accordingly, the toner can respond to even a small development electric field in the development area. As a result, if conditions satisfy that a toner is sufficiently conveyed to the development area, the development ends when photosensitive element potential (post-exposure potential) under a state that a toner is adhered to the photosensitive belt 1 becomes substantially equal to the development potential. In other words, saturation development can be easily performed. When an adhesion between a toner and the toner carrying roller 81 is very small, development can be performed in accordance with latent-image potential of pixels exposed to light, so that a high quality image can be output stably.

EXAMPLE 4

A general configuration of a printer according to Example 4 is the same as that of Example 3, and is shown in FIG. 13. An operation of the printer as a whole is also similar to Example 3, therefore explanation of it is omitted. Similarly to Example 3, the printer includes two operational modes, namely, the fast-operation mode for outputting a color image with narrow color reproducibility at a high speed, and the slow-operation mode for outputting a color image with wide color reproducibility at a low speed.

Example 4 is difference from Example 3 in a method of forming toner images of four colors on the photosensitive belt 1 not to form a toner image of a next color on a pixel on which there is a toner image of a previous color on the photosensitive belt 1, i.e., not to superimpose toner images.

Aspects according to Example 4 different from Example 3 are explained below. According to Example 4, values of development potential of the developing devices 3 and the amounts of electrostatic charges of respective color toners are set in a descending manner from upstream to downstream in the rotational direction of the photosensitive belt 1. In other words, according to Example 4, values of development potential of the developing devices 3Y, 3M, 3C, and 3K and the amounts of electrostatic charges of respective color toners for development descend in the order of the developing devices 3Y, 3M, 3C, and 3K.

The developing devices 3Y, 3M, 3C, and 3K used in Example 4 are non-contact developing devices similarly to Example 3, therefore detailed explanation is omitted.

According to Example 4, also the developing devices 3 develop electrostatic latent images on the photosensitive belt 1 with toners of respective colors, and so-called saturation development is performed. Any development device that can perform saturation development can be expected to have a similar effect, therefore development devices are not limited to the developing devices 3.

A method of forming toner images of four colors on the photosensitive belt 1 according to Example 4 is explained below with reference to FIG. 16. It is assumed that the thickness of the photosensitive layer 11 of the photosensitive belt 1 to be used is 30 μm. First of all, development potential of the developing device 3Y for the first color is set to −400 volts, and the amount of electrostatic charge of a yellow toner is set to −40 μC/g.

When an electrostatic latent image for a yellow toner image is developed under the above condition, potential generated by a toner layer of the yellow toner image with a toner development amount at 0.45 mg/cm$^2$ is −250 volts. Consequently, photosensitive-element surface potential including the toner layer of the developed yellow toner image is −350 volts by adding −250 volts with −100 volts of the post-exposure potential.

Then, development potential of the developing device 3M for the second color is set to −350 volts, and the amount of electrostatic charge of a magenta toner is set to −32 μC/g.

When an electrostatic latent image for a magenta toner image is developed under the above condition, potential generated by a toner layer of the magenta toner image with a toner development amount at 0.45 mg/cm$^2$ is −200 volts. Consequently, photosensitive-element surface potential including the toner layer of the developed magenta toner image is −300 volts by adding −200 volts with −100 volts of the post-exposure potential.

Compared with −350 volts of the development potential of the developing device 3M, the potential of pixels on the photosensitive belt surface on which the yellow toner image is already formed is −350 volts, so that any of the pixels on which the yellow toner image is formed is not developed with the magenta toner.

Furthermore, development potential of the developing device 3C for the third color is set to −300 volts, and the amount of electrostatic charge of a cyan toner is set to −25 μC/g.

When an electrostatic latent image for a cyan toner image is developed under the above condition, potential generated by a toner layer of the cyan toner image with a toner development amount at 0.45 mg/cm$^2$ is −150 volts. Consequently, photosensitive-element surface potential including the toner layer of the developed cyan toner image is −250 volts by adding −150 volts with −100 volts of the post-exposure potential.

Compared with −300 volts of the development potential of the developing device 3C, the potential of pixels on the photosensitive belt surface on which the yellow toner image or the magenta toner image is already formed is −300 volts or more, so that any of the pixels on which the yellow toner image or the magenta toner is formed is not developed with the cyan toner.

Finally, development potential of the developing device 3K for the fourth color is set to −250 volts, and the amount of electrostatic charge of a cyan toner is set to −15 μC/g.

When an electrostatic latent image for a black toner image is developed under the above condition, potential generated by a toner layer of the black toner image with a toner development amount at 0.45 mg/cm$^2$ is −100 volts. Consequently, photosensitive-element surface potential including the toner layer of the developed black toner image is −200 volts by adding −100 volts with −100 volts of the post-exposure potential.

Compared with −250 volts of the development potential of the developing device 3K, the potential of pixels on the photosensitive belt surface on which the yellow toner image, the magenta toner image, or the cyan toner image is already formed is −250 volts or more, so that any of the pixels on which the yellow toner image, the magenta toner image, or the cyan toner image is formed is not developed with the black toner.

According to Example 4, as described above, an image can be formed such that toner images of more than one color are not superimposed on any point at the same position on the photosensitive belt 1, and development amounts of respective colors can be equal. Because of such principle, charging for the second and later colors is not needed, therefore, the developing device is not required more than one. According to Example 4, although an electrostatic latent image is developed by using a negatively-charged toner by negatively charging the photosensitive belt by the charging device 2, an electrostatic latent image can also be developed by using a positively-charged toner by positively charging the photosensitive belt 1 by the charging device 2.

Because the developing devices 3 perform development by forming a cloud, an influence of the adhesion between the toner carrying roller 81 and a toner can be made small. Accordingly, the toner can respond to even a small development electric field in the development area. As a result, even if latent-image potential is not large, development can be sufficiently performed. This is very effective, because values of development potential of the developing devices 3 are set in a descending manner in order as described above according to Example 4, so that large latent-image potential cannot be ensured. When an adhesion between a toner and the toner carrying roller 81 is very small, development can be performed in accordance with latent-image potential of pixels exposed to light, so that a high quality image can be output stably.

EXAMPLE 5

A general configuration of an image forming apparatus according to Example 5 is the same as that of Example 3, and is shown in FIG. 13. An operation of the printer as a whole is also similar to Example 3, therefore explanation of it is omitted. Similarly to Example 3, the image forming apparatus includes two operational modes, namely, the fast-operation mode for outputting a color image with narrow color reproducibility at a high speed, and the slow-operation mode for outputting a color image with wide color reproducibility at a low speed.

Example 5 is difference from Example 3 in a method of forming toner images of four colors on the photosensitive belt not to form a toner image of a next color on a pixel on which there is a toner image of a previous color on the photosensitive belt 1, i.e., not to superimpose toner images.

A process of forming toner images of more than one color on the photosensitive belt 1 is explained below. According to the second embodiment, an image is formed by rotating the photosensitive belt 1 in the directions of arrows as shown in FIGS. 13 and 14.

To begin with, the surface of the photosensitive belt 1 is uniformly charged to −500 volts by the charging device 2. The charging device 2 is not particularly limited, and any conventionally-known charging device can be used. An image part for yellow is then exposed to light from the backside of the photosensitive layer 11 (the inner side of the photosensitive belt loop) by the organic EL layer 18, and photosensitive-element surface potential of a light-exposed part is reduced. The surface potential of the light-exposed part is called post-exposure potential. In this way, an electrostatic latent image for yellow can be formed by reducing potential of only pixels corresponding to a yellow image on the photosensitive belt surface that is uniformly charged at −500 volts. After that, the electrostatic latent image is developed with a yellow toner by the developing device 3Y, and then a yellow toner image is formed on the photosensitive belt 1.

A magenta toner image is then created on the photosensitive belt 1 on which the yellow toner image has been formed, through processes of exposing and developing similar to those for yellow.

According to the second embodiment, it is configured not to superimpose the magenta toner image on a pixel on which the yellow toner image is already formed, and not to superimpose toner images of the rest of the colors, namely, cyan and black, i.e., not to superimpose a toner image of a next color on a pixel on which there is a toner image of any previous color.

In this way, toner images of four colors of yellow, magenta, cyan, and black, are formed on the photosensitive belt 1.

A difference between Example 5 and Example 3 is that the exposure light intensity of the light emitting elements when forming an electrostatic latent image is set in an ascending manner and the values of development potential of the developing devices 3 are set in a descending manner, from upstream to downstream in the rotational direction of the photosensitive belt 1.

The developing devices 3Y, 3M, 3C, and 3K used in Example 5 are a non-contact type, and similar to Examples 3, therefore details explanations are omitted.

According to Example 5, also the developing devices 3 develop electrostatic latent images on the photosensitive belt 1 with toners of respective colors, and particularly perform so-called saturation development. As long as a developing device can perform saturation development, a similar effect can be expected, so that the developing device is not limited to the developing devices 3.

Figure 17:
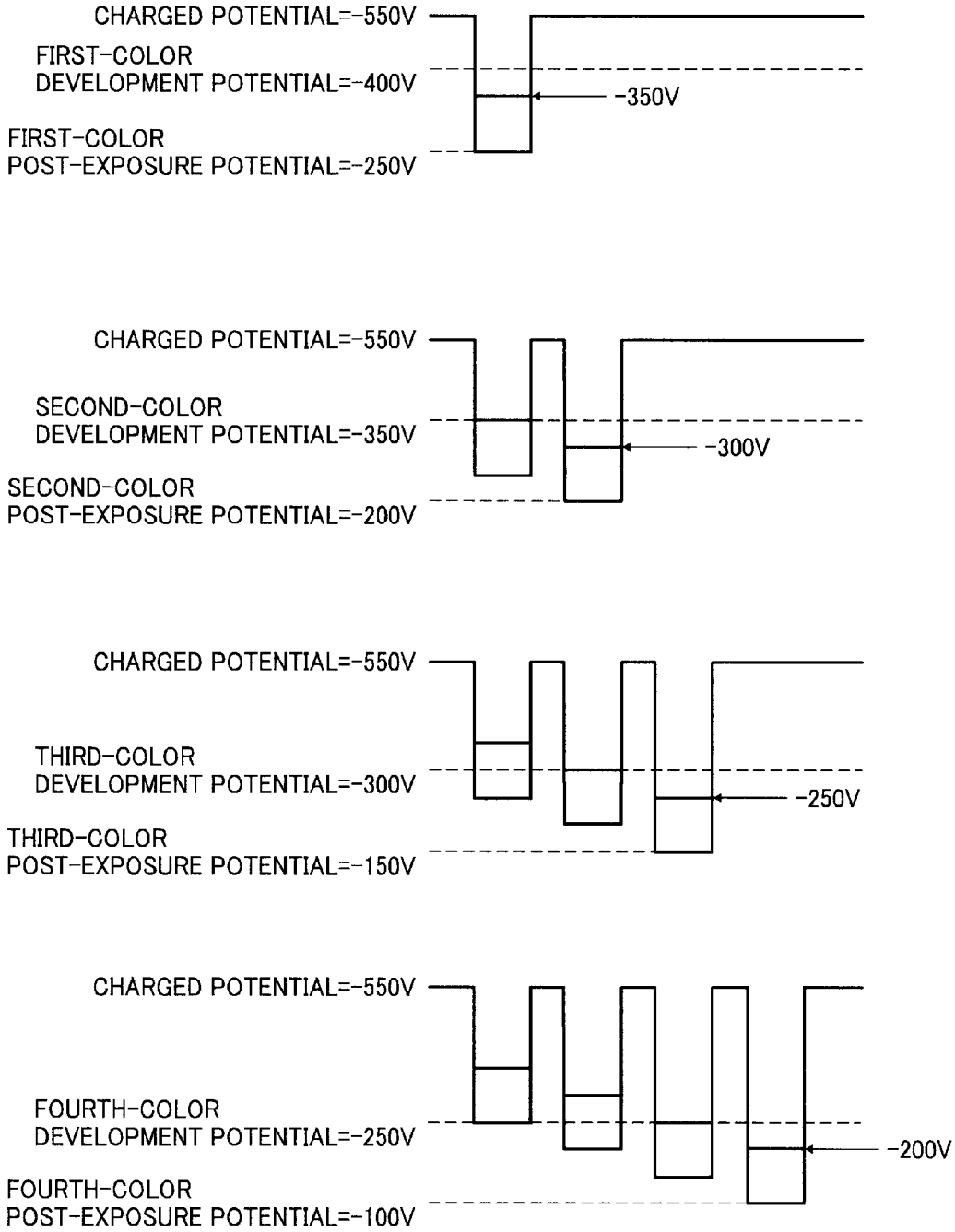
FIG. 17 is a schematic diagram for explaining values of potential on a photosensitive belt and a toner image surface in Example 5.

A method of forming toner images of four colors on the photosensitive belt 1 according to Example 5 is explained below with reference to FIG. 17. It is assumed that the thickness of the photosensitive layer 11 of the photosensitive belt 1 to be used is 30 μm, and the amounts of electrostatic charge of toners of respective colors are all the same, −15 μC/g.

First of all, development potential of the developing device 3Y for the first color is set to −400 volts, and an electrostatic latent image for yellow is formed on the photosensitive belt 1 with the exposure light intensity with which post-exposure potential becomes −250 volts. When the electrostatic latent image is developed with a yellow toner under the above condition, potential generated by a toner layer of the yellow toner image with a toner development amount at 0.45 mg/cm$^2$ is −100 volts. Consequently, photosensitive-element surface potential including the toner layer of the developed yellow toner image is −350 volts by adding −100 volts with −250 volts of the post-exposure potential.

Then, development potential of the developing device 3M for the second color is set to −350 volts, and an electrostatic latent image for magenta is formed on the photosensitive belt 1 with the exposure light intensity with which post-exposure potential becomes −200 volts. When the electrostatic latent image is developed with a magenta toner under the above condition, potential generated by a toner layer of the magenta toner image with a toner development amount at 0.45 mg/cm$^2$ is −100 volts. Consequently, photosensitive-element surface potential including the toner layer of the developed magenta toner image is −300 volts by adding −100 volts with −200 volts of the post-exposure potential.

Compared with −350 volts of the development potential of the developing device 3M, the potential of pixels on the photosensitive belt surface on which the yellow toner image is already formed is −350 volts, so that any of the pixels on which the yellow toner image is formed is not developed with the magenta toner.

Furthermore, development potential of the developing device 3C for the third color is set to −300 volts, and an electrostatic latent image for cyan is formed on the photosensitive belt 1 with the exposure light intensity with which post-exposure potential becomes −150 volts. When the electrostatic latent image is developed with a cyan toner under the above condition, potential generated by a toner layer of the cyan toner image with a toner development amount at 0.45 mg/cm$^2$ is −100 volts. Consequently, photosensitive-element surface potential including the toner layer of the developed cyan toner image is −250 volts by adding −100 volts with −150 volts of the post-exposure potential.

Compared with −300 volts of the development potential of the developing device 3C, the potential of pixels on the photosensitive belt surface on which the yellow toner image or the magenta toner image is already formed is −300 volts or more, so that any of the pixels on which the yellow toner image or the magenta toner is formed is not developed with the cyan toner.

Finally, development potential of the developing device 3K for the fourth color is set to −250 volts, and an electrostatic latent image for black is formed on the photosensitive belt 1 with the exposure light intensity with which post-exposure potential becomes −100 volts. When the electrostatic latent image is developed with a black toner under the above condition, potential generated by a toner layer of the black toner image with a toner development amount at 0.45 mg/cm$^2$ is −100 volts. Consequently, photosensitive-element surface potential including the toner layer of the developed black toner image is −200 volts by adding −100 volts with −100 volts of the post-exposure potential.

Compared with −250 volts of the development potential of the developing device 3K, the potential of pixels on the photosensitive belt surface on which the yellow toner image, the magenta toner image, or the cyan toner image is already formed are −250 volts or more, so that any of the pixels on which the yellow toner image, the magenta toner image, or the cyan toner image is formed is not developed with the black toner.

According to Example 5, as described above, an image can be formed such that toner images of more than one color are not superimposed on any point at the same position on the photosensitive belt 1, and development amounts of respective colors can be equal. Because of such principle, charging for the second and later colors is not needed, therefore, the developing device is not required more than one. According to Example 5, although an electrostatic latent image is developed by using a negatively-charged toner by negatively charging the photosensitive belt by the charging device 2, an electrostatic latent image can also be developed by using a positively-charged toner by positively charging the photosensitive belt 1 by the charging device 2.

Because the developing devices 3 perform development by forming a cloud, an influence of the adhesion between the toner carrying roller 81 and a toner can be made small. Accordingly, the toner can respond to even a small development electric field in the development area. As a result, even if latent-image potential is not large, development can be sufficiently performed. This is very effective, because exposure light intensity and values of development potential are set in a descending manner in order as described above according to Example 5, so that large latent-image potential cannot be ensured. When an adhesion between a toner and the toner carrying roller 81 is very small, development can be performed in accordance with latent-image potential of pixels exposed to light, so that a high quality image can be output stably.

As described above, according to the first embodiment, a toner image of a next color is formed on a single photosensitive belt in a part in which there is no toner image of any previous color. Accordingly, an electrostatic latent image for a next color can be formed with the organic EL layer 18 onto the photosensitive belt 1 that is charged with the charging device 2 without receiving influence of potential of toner images of the previous colors. As a result, by developing the electrostatic latent image with a toner of the next color by the developing device 3, a toner image of the next color can be formed on the single photosensitive belt with the same toner amount, so that uneven density does not appear in the toner image of the next color. Moreover, in addition to the toners of yellow, magenta, cyan, and black that are used in a typical image forming apparatus, toners of red, green, and blue are used to develop latent images for respective colors by the developing devices 3. In a typical image forming apparatus, magenta and yellow toner images are superimposed to make red, and yellow and cyan toner images are superimposed to make green, and cyan and magenta toner images are superimposed to make blue. In the first embodiment, a toner image of a color that a typical image forming apparatus reproduces by superimposing toners of more than one color can be formed by developing an electrostatic latent image by using a toner of the color that would be reproduced by the superimposition otherwise. Accordingly, color reproducibility of a color image can be ensured without superimposing toner images of respective colors on any point at the same position on the photosensitive belt. Therefore, uneven density caused by influence of a toner image of a previous color in an image forming process for the second or later color can be suppressed, and a high-quality color image can be formed.

Moreover, according to the first embodiment, it is suppressed that two or more colors from among toner images of respective colors are formed in a superimposed manner on a point at the same position on a single unit of the photosensitive belt 1.

According to the second embodiment, a toner image of a next color is formed on the photosensitive belt 1 in a part in which there is no toner image of any previous color. Accordingly, an electrostatic latent image for the next color can be formed with the organic EL layer 18 onto the photosensitive belt 1 that is charged with the charging device 2 without receiving influence of potential of toner images of the previous colors. As a result, by developing the electrostatic latent image with a toner of the next color by the developing device 3, a toner image of the next color can be formed on the photosensitive belt 1 with the same toner amount, so that uneven density does not appear in the toner image of the next color. Moreover, a toner image of a color to be reproduced by superimposing toner images of respective colors can be formed on the intermediate transfer belt 8, without superimposing the toner images of the respective colors on a point at the same position of the photosensitive belt 1. Accordingly, by repeating twice or more a series of the processes described above, superimposing toner images of respective colors on the intermediate transfer belt 8, and forming a color toner image of more than one color, color reproducibility of the color toner image of the more than one color can be ensured. Therefore, uneven density caused by influence of a toner image of a previous color in an image forming process for the second or later color can be suppressed, and a high-quality color image can be formed.

Furthermore, according to the second embodiment, it is suppressed that two or more colors from among toner images of respective colors are formed in a superimposed manner on a point at the same position of the photosensitive belt 1.

Moreover, according to the second embodiment, a color image can be arbitrarily formed by one of the operational modes, namely, the slow-operation mode for outputting a color image with wide color reproducibility at a low speed, and the fast-operation mode for outputting a color image with narrow color reproducibility at a high speed.

Furthermore, according to each of the embodiments, the photosensitive belt 1 can form thereon electrostatic latent images each on an appropriate position with a high degree of precision in units of pixel, thereby preventing toner images of more than one color from being formed in a superimposed manner on a point at the same position of the photosensitive belt 1 due to misalignment of the positions of the electrostatic latent images during exposing to light.

Moreover, according to each of the embodiments, the charging device 2 is used not more than one. Accordingly, downsizing of the apparatus and cost saving can be achieved. In addition, because charging for the second and later colors is not to be performed, a problem associated with uniform charging for the second and later color does not arise, so that a high quality image can be output stably.

Furthermore, according to each of the embodiments, a plurality of the developing devices 3 is configured to perform saturation development, thereby avoiding developing pixels of a formed toner image of a color with another color toner.

Moreover, according to the second embodiment, the values of development potential of the developing devices 3 are set in a descending manner, and also the amounts of electrostatic charge of respective toners stored in the developing devices 3 are set in a descending manner, from upstream to downstream in the rotational direction of the photosensitive belt 1, thereby avoiding developing pixels of a formed toner image of a color with another color toner.

Furthermore, according to the second embodiment, the amounts of light emission of the light emitting elements are set in an ascending manner, and the values of development potential of the developing devices 3 are set in a descending manner, from upstream to downstream in the rotational direction of the photosensitive belt 1, thereby avoiding developing pixels of a formed toner image of a color with another color toner.

Moreover, according to each of the embodiments, a state (called a toner cloud) is formed such that a toner on the toner carrying roller 81 is floating, so that an adhesion between a toner and the toner carrying roller 81 is very small. Accordingly, even if development potential (difference between photosensitive belt potential of an image part and development potential) is small, development can be sufficiently performed without contact. Moreover, if small development potential is acceptable, a potential difference between development bias and a non-image part can be set large without changing charged potential of the photosensitive belt 1, thereby suppressing background stain. Furthermore, when an adhesion between a toner and the toner carrying roller 81 is very small, development can be performed in accordance with latent-image potential, so that an image of a high quality image with a high dot-reproducibility can be obtained.

Moreover, according to each of the embodiments, toners carried on the surface of the toner carrying roller 81 can be easily conveyed to the development area.

Furthermore, according to each of the embodiments, toner carried on the toner carrying roller 81 can be conveyed to the development area through traveling-wave electric field without rotating the toner carrying roller 81, so that no driving unit for rotating the toner carrying roller 81 is needed, consequently the apparatus body can be further reduced in size.

As a latent-image forming unit according to each of the embodiments, a conventionally-known light exposing device can be used, which forms an electrostatic latent image by exposing to light a surface of a photosensitive belt on a side on which toner images are to be formed, with a laser beam.

According to an aspect of the present invention, uneven density caused by influence of a toner image of a previous color in an image forming process of the second or later color can be suppressed, and a high-quality color image can be formed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

an image carrier;

a charging unit that charges a surface of the image carrier;

a latent-image forming unit, which is included in the image carrier and includes a light-emitting element layer including light emitting elements, that forms a latent image for each of a plurality of different colors by exposing the surface of the image carrier charged by the charging unit, and that controls light emission of the light emitting elements in units of pixels to form each latent image on the image carrier; and a plurality of developing units that sequentially develop latent images formed on the image carrier, the latent images being developed with toners of the different colors including at least cyan, yellow, magenta, blue, green, and red, to form a color toner image, wherein each of the developing units develops a respective latent image at different positions on the image carrier such that the toner images of the different colors do not overlap.

2. The image forming apparatus according to claim 1, further comprising a color-separation processing unit that separates color image data corresponding to the color toner image into a plurality of color image data corresponding to the different colors, wherein the latent-image forming unit forms the latent images for the different colors based on the separated color image data.

3. The image forming apparatus according to claim 1, wherein the image carrier includes at least the light-emitting element layer including the light emitting elements as the latent-image forming unit, a transparent electrode layer, and a photosensitive layer formed in order on a substrate.

4. The image forming apparatus according to claim 1, wherein the developing units are arranged along the surface of the image carrier that makes an endless surface movement in a direction of the surface movement, the charging unit is arranged upstream of a most upstream developing unit among the developing units in the direction of the surface movement, and each of the toner images of the different colors is formed in one rotation of the image carrier after the charging unit charges the surface of the image carrier.

5. The image forming apparatus according to claim 4, wherein each of the developing units performs a saturation development in which an amount of toner of a toner image on the image carrier is sufficient with respect to a development potential.

6. The image forming apparatus according to claim 5, wherein development potentials of the developing units and amounts of charges of the toners in the developing units decrease from upstream to downstream in the direction of the surface movement.

7. The image forming apparatus according to claim 5, wherein light intensities of the light emitting elements increase and development potentials of the developing units decrease from upstream to downstream in the direction of the surface movement.

8. The image forming apparatus according to claim 1, wherein each of the developing units includes a toner carrier that is arranged to oppose the image carrier in a non-contact state in a developing area, a plurality of electrodes provided on the toner carrier along a surface of the toner carrier being isolated from each other, and a hopping-electric-field generating unit that applies voltages of different phases to the electrodes so that adjacent electrodes have different phases for hopping a toner.

9. The image forming apparatus according to claim 8, wherein the toner carrier is a rotating member that makes a surface movement and conveys a toner carried on the surface of the toner carrier to the developing area.

* * * * *